United States Patent [19]

Schmidt et al.

[11] Patent Number: 4,585,171

[45] Date of Patent: Apr. 29, 1986

[54] FUEL INJECTION UNIT FOR A DIESEL ENGINE CYLINDER

[75] Inventors: Harald Schmidt; Josef Morell, both of Vienna; Günther Herdin, Steyr; Otto Freudenschuss, Vienna, all of Austria

[73] Assignee: Steyr-Daimler-Puch Aktiengesellschaft, Vienna, Austria

[21] Appl. No.: 708,991

[22] Filed: Mar. 7, 1985

[30] Foreign Application Priority Data

Mar. 8, 1984 [AT] Austria ..... 774/84

[51] Int. Cl.[4] ..... F02M 59/00

[52] U.S. Cl. ..... 239/88; 239/90; 239/124

[58] Field of Search ..... 239/88–95, 239/124

[56] References Cited

U.S. PATENT DOCUMENTS 2,571,501 10/1951 Truxell, Jr. ..... 239/90

FOREIGN PATENT DOCUMENTS 97429 1/1984 European Pat. Off. ..... 239/88
958440 2/1957 Fed. Rep. of Germany ..... 239/124
1172897 6/1964 Fed. Rep. of Germany ..... 239/124

*Primary Examiner*—Andres Kashnikow
*Attorney, Agent, or Firm*—Karl F. Ross; Herbert Dubno

[57] ABSTRACT

A fuel injection unit for each cylinder of a diesel engine includes a housing which accommodates a piston pump and an injection nozzle. The piston pump includes a cylinder liner in which a piston runs and controls a flow passage radially extending in the cylinder liner. The flow passage communicates with a supply space which is provided between the housing and the cylinder liner and is divided in vicinity of the flow passage by a baffle sleeve. The so formed two chambers are connected to separate inlet and outlet lines, i.e. that one chamber is connected to the inlet line while the other chamber communicates with the outlet line.

6 Claims, 1 Drawing Figure

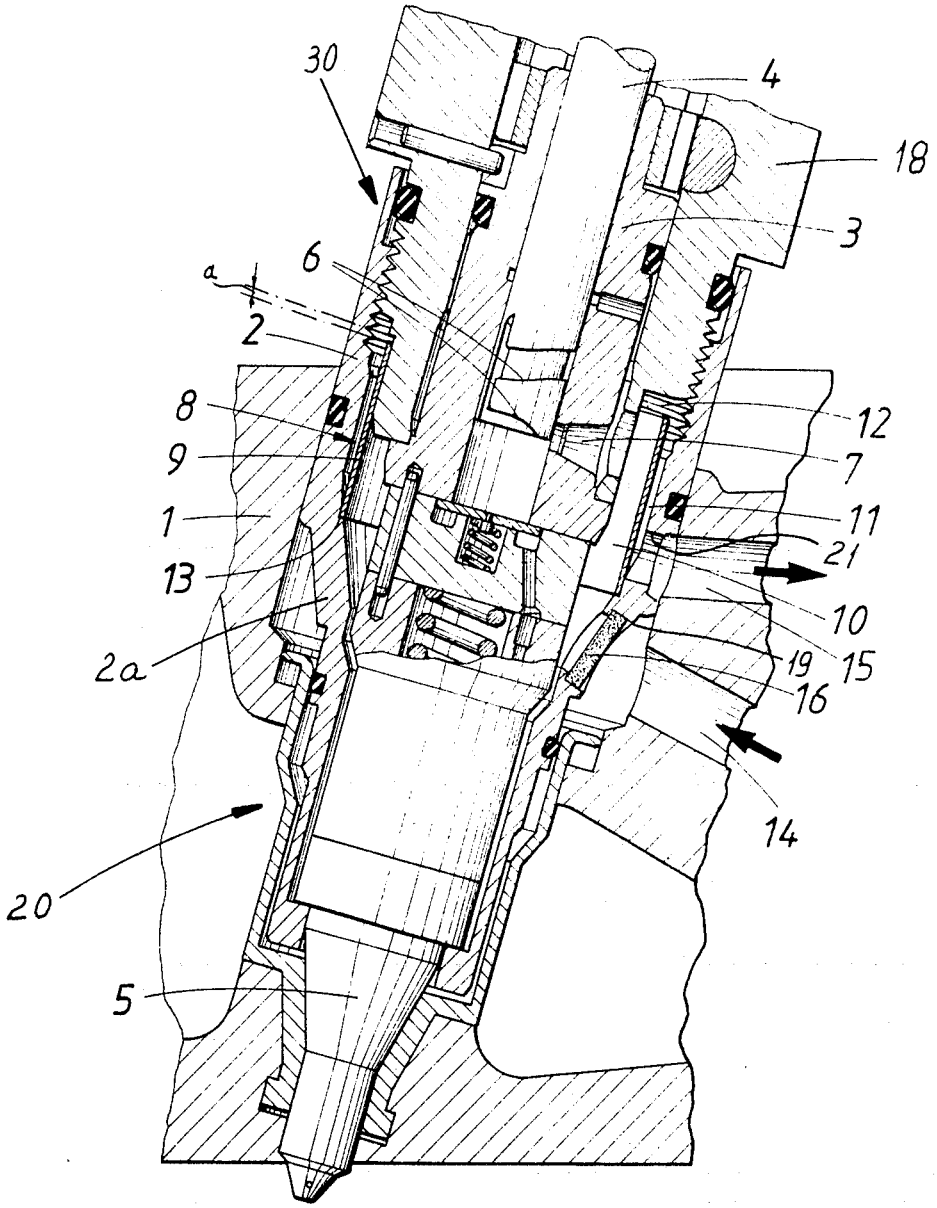
30
4
18
3
6
a
2
8
12
9
7
1
11
21
13
10
2a
19
15
16
14
20
5

FUEL INJECTION UNIT FOR A DIESEL ENGINE CYLINDER

FIELD OF THE INVENTION

Our present invention refers to a fuel injection unit for each cylinder of a diesel engine, and in particular to a monobloc injection pump and nozzle.

BACKGROUND OF THE INVENTION

In general, such a monoblock injection pump and nozzle uses a common housing for accommodating a piston pump as well as an injection nozzle. The piston pump includes a cylinder liner and a piston running within the cylinder liner. The piston controls one or more flow passages which radially extend in the cylinder liner and communicate with a supply space defined between the housing and the piston pump. Within this supply space, a baffle sleeve is arranged in vicinity of the flow passage to provide two chambers which communicate with each other.

The baffle sleeves used in such fuel injection units avoid an erosion of the housing wall along the area facing the flow passage because the returning sharp fuel jet discharged through the flow passage is deflected by the baffle sleeve and thus is prevented from inpinging upon the housing walls. The baffle sleeves are thus, however, subjected to wear and must be replaceable after a certain period even when made of special low wear materials.

From the German specifications DE-OS No. 24 42 010 and DE-OS No. 24 42 088 as well as from the German Pat. No. 11 72 897, fuel injection units are known which employ such baffle sleeves to subdivide the supply space. Leading into the supply space is one fuel line which provides the supply as well as the discharge of fuel. Consequently, only a slight circulation without any preferred direction prevails in the supply space. This leads to an accumulation of air bubbles.

The presence of air bubbles is disadvantageous as the pump delivery is irregular and eventually causes injection of a fluctuating fuel quantity resulting in an irregular engine output. Moreover, since the fuel is heated up in each injection unit of a corresponding cylnder to a different level, the low circulation is insufficient to provide a balancing to compensate for these different temperatures.

The German Pat. No. 958 440 describes the use of separate inlet and outlet lines for the fuel; however, this patent is concerned with a different construction, i.e. the inlet and outlet are not in communication with a common fuel supply space.

OBJECTS OF THE INVENTION

It is thus the principal and general object of our invention to provide an improved fuel injection unit obviating the aforestated drawbacks.

In particular, it is an object of the invention to provide a fuel injection unit in which an accumulation of air bubbles is prevented and a uniform fuel temperature is obtained in all cylinders.

SUMMARY OF THE INVENTION

We realize these objects by providing separate inlet and outlet lines for the supply space in such a manner that one chamber is connected to the inlet line while the other chamber, separated from the first by the baffle wall, communicates with the outlet line.

Through the provision of separate inlet and outlet lines, a permanent circulation within the supply space is obtained. The baffle sleeve which extends in axial direction within the supply space is thus not only used to deflect fuel discharged through the flow passage and to prevent erosion of the housing but the obtained subdivision in radial direction of the supply space into an inner chamber and an outer chamber is utilized to allow separate connection of the inlet and outlet lines. Air bubbles are prevented from accumulating and varying temperatures of the fuel within the individual units are avoided by the provided circulation so that all injection units operate in a uniform manner.

According to the teachings of our invention, the sleeve is provided with at least one recess at its upper end to allow communication between the inner and the outer chamber. To obtain a sufficient circulation within the supply space and to provide a desired cooling of the piston pump, the inner chamber is connected to the inlet line at an axial distance to the recess which provides the communication between the chambers. At this recess, an increased flow velocity is obtained which in turn allows an increased discharge of air bubbles. Moreover, a circulation about the entire length of the baffle sleeve is obtained.

According to a further feature of the invention, the baffle sleeve is supported with its lower end by a shoulder provided at the inner wall of the housing. Advantageously, the sleeve is supported with an axial play so as to allow rotation about its axis during operation. Thus, the sharp and abrasive fuel jet discharged through the flow passage in the cylinder liner is prevented from impinging the baffle sleeve permanently at the same spot so that its durability is extended.

BRIEF DESCRIPTION OF THE DRAWING

The above and other objects, features and advantages of our present invention will now be described in more detail with reference to the accompanying drawing in which the sole FIGURE is an axial sectional view of a fuel injection unit according to the invention.

SPECIFIC DESCRIPTION

The fuel injection unit for one cylinder of a diesel engine shown in the drawing is generally designated by reference numeral 20.

The injection unit 20 is inserted into a cylinder head 1 and includes a piston pump which is partly shown and generally characterized by reference numeral 30.

The piston pump 30 includes a housing 2 which is sealed against the cylinder head 1 and whose inner side is connected to a sleeve-like block portion 18.

Accommodated within the block portion 18 and forming part of the piston pump 30 is a pump element comprising a cylinder liner 3 and a piston 4 which runs within the cylinder liner 3 to control the delivery of fuel in a required amount at a correct moment to an injection nozzle 5. The present invention has a monobloc injection pump and nozzle which means that the injection nozzle 5 is directly connected to the piston pump 30 and thus arranged in the housing 2 as well.

The piston 4 is provided with a helical or curved recess to define so-called control edges 6 at its circumference. By means of a rocker lever or the like and a tappet, the piston 4 is rotated along the control edges 6 against the pressure of a spring to control the quantity of fuel to be injected through the nozzle 5. Since the actuation of the piston pump 30 and the pump elements is known per se, these parts are not shown in detail.

Cooperating with the helical control edges 6 is at least one flow passage 7 which extends radially within the cylinder liner 3 through which returning fuel is discharged.

As is shown in the drawing, the housing 2 extends with its upper portion essentially parallel at a distance to the cylinder liner 3 so as to define a supply space 8 therebetween which communicates with the flow passage 7. The supply space 8 is subdivided in vicinity of the flow passage 7 by an axially extending baffle sleeve 9 into an inner chamber 10 between the cylinder liner 3 and the sleeve 9 and an outer chamber 11 between the sleeve 9 and the housing 2.

The baffle sleeve 9 is supported with its lower end by a shoulder 13 which is formed at the inner wall of a center portion 2*a* of the housing 2 which center portion 2*a* is tapered in direction towards the injection nozzle 5.

The upper portion of the baffle sleeve 9 lies against the block portion 18. As can be seen at the left hand side of the FIGURE, the baffle sleeve 9 is supported by the housing 2 and the block portion 18 with a certain axial play so as to allow rotation of the sleeve 9 during operation i.e. when fuel flows through the passage 7 onto the sleeve 9. Consequently, the fuel is prevented from impinging the sleeve 9 continuously at a same spot so that its durability is considerably increased.

At its upper portion, the baffle sleeve 9 is provided with at least one recess 12 for allowing communication between the inner chamber 10 and the outer chamber 11. In order to provide a continuous flow within the supply space 8 and to obtain a transfer of heat, the chambers 10, 11 are connected to separate inlet and outlet lines 14, 15. The central portion 2*a* of the housing 2 is provided with a port 19 which accommodates a filter 16 and connects the inner chamber 10 with the inlet or supply line 14. The connection of the supply line 14 with the inner chamber 10 via port 19 is thus provided at an axial distance to the recess 12.

A further port 21 is provided in the housing above the port 19 to connect the outer chamber 11 with the outlet line 15. Since the chambers 10, 11 communicate with each other via the recess 12 and are separately connected to respective inlet or outlet lines 14, 15, a circulation is provided within the supply chamber 8 so that gas bubbles are easily discharged and prevented from accumulating within the latter. In particular, fuel flows along the nozzle 5 and the cylinder liner 3 to the recess 12 and eventually is discharged via the outer chamber 11 through the outlet line 15.

We claim:

1. A fuel injection unit for a diesel engine, comprising:

a housing defining an axis;

a piston pump including a pump element acommodated within said housing and defining at least one flow passage through which returning fuel is discharged, said pump element and said housing defining a supply space therebetween which is in communication with said flow passage;

a nozzle means connected to said pump element;

baffle means dividing said supply space into two chambers in vicinity of said flow passage so as to protect said housing from impinging fuel discharged through said flow passage;

inlet means connected to one of said chambers for allowing supply of fuel into said supply space; and outlet means connected to the other of said chambers for allowing discharge of fuel from said supply space.

2. A fuel injection unit as defined in claim 1 wherein said pump element includes a cylinder liner and a piston running in said cylinder liner, said flow passage being provided in said cylinder liner and being controlled by said piston.

3. A fuel injection unit as defined in claim 1 wherein said housing is provided at its inner surface facing said pump element with a shoulder, said baffle means including a sleeve supported by said shoulder and extending axially within said supply space between said housing and said pump element so that said chambers are arranged abreast in radial direction to define an inner and an outer chamber.

4. A fuel injection unit as defined in claim 3 wherein said sleeve is provided with at least one recess at its upper portion remote to said shoulder to allow communication between said chambers.

5. A fuel injection unit as defined in claim 4 wherein said inner chamber is connected to said inlet means via a port located at an axial distance to said recess.

6. A fuel injection unit as defined in claim 3 wherein said sleeve is supported in said housing with an axial play to allow rotation thereof during operation.

* * * * *